US005585321A

United States Patent [19]

Breen et al.

[11] Patent Number: 5,585,321

[45] Date of Patent: Dec. 17, 1996

[54] ENHANCED THERMAL PAPERS WITH IMPROVED IMAGING CHARACTERISTICS

[75] Inventors: Thomas J. Breen, Northbrook, Ill.; David J. Barbee, Nashville, Tenn.; Mark G. Lang, Clifton, N.J.

[73] Assignee: Rand McNally & Company, Skokie, Ill.

[21] Appl. No.: 319,732

[22] Filed: Oct. 7, 1994

Related U.S. Application Data

[63] Continuation-in-part of Ser. No. 149,286, Nov. 9, 1993, abandoned, and Ser. No. 280,051, Jul. 25, 1994, abandoned.

[51] Int. Cl.[6] ..... B41M 5/40

[52] U.S. Cl. ..... 503/226; 427/152; 428/409; 503/200

[58] Field of Search ..... 427/152; 428/409; 503/200, 226

[56] References Cited

U.S. PATENT DOCUMENTS

| | | | |
|---|---|---|---|
| 4,370,370 | 1/1983 | Iwata et al. | 428/40 |
| 4,388,362 | 6/1983 | Iwata et al. | 428/211 |
| 4,444,819 | 4/1984 | Maruta et al. | 503/209 |
| 4,535,347 | 8/1985 | Glanz | 503/208 |
| 4,740,495 | 4/1988 | Marinelli et al. | 503/214 |
| 4,812,438 | 3/1989 | Yamori et al. | 503/200 |
| 4,829,046 | 5/1989 | Whitcomb | 503/211 |
| 4,835,133 | 5/1989 | Yanahihara et al. | 503/210 |
| 4,845,072 | 7/1989 | Furuya et al. | 503/209 |
| 4,927,801 | 5/1990 | Mahmud | 503/200 |
| 4,946,823 | 8/1990 | Nakamura et al. | 503/200 |
| 4,962,079 | 10/1990 | Matsumoto et al. | 503/226 |
| 4,977,133 | 12/1990 | Ishida et al. | 503/226 |
| 5,008,231 | 4/1991 | Yoshizawa et al. | 503/207 |
| 5,047,383 | 9/1991 | Hayashi et al. | 503/200 |
| 5,061,677 | 10/1991 | Yoshida et al. | 503/226 |
| 5,087,603 | 2/1992 | Izubayashi et al. | 503/226 |
| 5,102,693 | 4/1992 | Motosugi et al. | 427/150 |
| 5,106,813 | 4/1992 | Hoshino et al. | 503/207 |
| 5,108,980 | 4/1992 | Hotta et al. | 503/226 |
| 5,116,804 | 5/1992 | Kakusa et al. | 503/209 |
| 5,134,113 | 7/1992 | Klug et al. | 503/216 |
| 5,135,776 | 8/1992 | Okachi et al. | 427/150 |
| 5,151,403 | 9/1992 | Suzuki et al. | 503/200 |
| 5,206,209 | 4/1993 | Minami et al. | 503/209 |
| 5,210,066 | 5/1993 | Sakurai et al. | 503/214 |
| 5,219,820 | 6/1993 | Morohoshi et al. | 503/204 |
| 5,219,821 | 6/1993 | Arbee et al. | 503/226 |
| 5,229,349 | 7/1993 | Kurisu et al. | 503/200 |
| 5,256,619 | 10/1993 | Yoshida et al. | 503/226 |
| 5,272,127 | 12/1993 | Mandoh et al. | 503/207 |

OTHER PUBLICATIONS

Appleton Optima Thermal Paper Product Guide.
Technical Information Sheet (2 pages) for Nacrylic CP3670.
Technical Service Information (2 pages) for Joncryl 89.
Appleton Optima Thermal Paper Product Sheets for T0862; T0864; T0964; T884(CHS; and T954.

*Primary Examiner*—B. Hamilton Hess
*Attorney, Agent, or Firm*—Laff, Whitesel, Conte & Saret, Ltd.

[57] ABSTRACT

Enhanced thermal papers having a thermosetting organic polymeric-material containing heat-metering layer which enhances the thermal characteristics of the papers and methods of enhancing imaging characteristics of thermal papers, including particularly facsimile papers, by depositing onto the heat-metering layers of such papers a thermosetting organic polymeric-material-containing heat-metering layer.

46 Claims, 1 Drawing Sheet

ENHANCED THERMAL PAPERS WITH IMPROVED IMAGING CHARACTERISTICS

This application is a continuation-in-part of U.S. patent application Ser. No. 08/149,286, filed Nov. 9, 1993, now abandoned and a continuation-in-part of U.S. patent application Ser. No. 08/280,051 filed Jul. 25, 1994, now abandoned.

BACKGROUND

This invention relates generally to thermal papers, and, more particularly, to thermal papers whose imaging characteristics are enhanced by the application of a tough, coarse surfaced heat-metering layer. This invention further relates to methods of making enhanced thermal papers having a tough, coarse surfaced heat-metering layer.

Thermal papers are used in a wide variety of thermal printers including facsimile machines, calculators, portable terminals, label printers, plotters, tag and ticket printers, printers for use with personal computers and other hard copy devices. Thermal imaging is widely used because it is economical, quiet, clean, and reliable.

Thermal papers generally comprise a substrate layer and a heat-sensitive recording layer which is applied to the substrate. The substrate is usually paper, although tag stock, pressure sensitive labels, laminated papers and backings, as well as synthetic substrates may be used.

A variety of different chemistries are used to produce images in the heat-sensitive recording layer. Generally, these chemistries include a dye system which changes color or "develops" on the application of heat, and a binding agent. A typical dye system, described for example in U.S. Pat. No. 5,256,619, uses a combination of a leuco dye and an acidic co-reactant.

Typically, images are formed in the heat-sensitive recording layer using a thermal printhead in which a matrix of point sources of heat are turned on and off to form the images as the thermal paper moves past the thermal printhead.

One of the most common uses of thermal papers is in machines for receiving facsimile transmissions. The thermal paper used with such facsimile machines is typically made as inexpensively as possible, using a thin paper substrate formed from mechanical pulps and as little of an inexpensive chemistry as possible in the heat-sensitive recording layer. The paper substrate typically will not be sized or calendared and therefore will have both voids in the paper surface and paper fibers which protrude into the heat-sensitive recording layer. Additionally, facsimile papers include a lubricant such as zinc stearate in the heat-sensitive recording layer. Facsimile papers have no topcoat, a feature found in more expensive, higher quality thermal papers, as discussed below.

Chart papers are thermal papers used in thermal plotters. They differ from the thermal papers used in facsimile machines primarily in that certain additives are present in the heat-sensitive recording layer to make that layer more durable. Like thermal papers used with facsimile machines, chart papers typically are not topcoated.

The image quality or definition obtained using facsimile paper is generally poor for various reasons, including those explained below, but it is considered acceptable since it is "person-readable". For example, portions of the image are lost where the heat-sensitive recording layer is disrupted by paper fibers protruding from the paper substrate or where the recording layer has voids or depressions due either to its thinness or to underlying voids in the paper substrate. Additionally, surface coarseness has been thought to interfere with heat transfer from the printhead, further impairing image quality.

Border areas of facsimile paper images often are irregular and extend beyond the image presented to the thermal printhead. This problem, which is known as "bloom", comes about due to heat flow into the heat-sensitive recording layer beyond the borders of the image presented by the heat point sources in the thermal printhead. The images produced with facsimile paper thus are inferior to those obtained with press or laser printing in which the printed images are sharply defined and correspond precisely to the images intended to be produced.

In addition to the undesirable bloom and limited image definition obtained with facsimile paper, such paper is also highly vulnerable to scuffing, erasures, and development of non-image areas upon exposure to organic solvents, water, oils, plasticizers, and other materials. Probably the most widely recognized problem with facsimile papers are the fingerprints arising from contact with the sebum of the fingers of the person handling the facsimile paper.

Thermal papers of significantly better quality than facsimile paper are available. In these papers, thicker, calendared and sized paper substrates are used in order to improve imaging characteristics as well as resistance to the above noted incompatible materials. In these papers, for example, the voids in the substrate surface which cause depressions in the heat-sensitive recording layer as well as the paper fibers which protrude into and disrupt the heat-sensitive recording layer typically will be minimized or eliminated. Additionally, in such improved thermal papers, the heat-sensitive recording layer may be made thicker and may employ more sophisticated chemistries which reduce undesirable bloom.

In such better quality thermal papers, protective topcoatings are applied over the heat-sensitive recording top layer in order to minimize or eliminate problems arising from exposure to solvents, water, light, plasticizers, and human sebum. Typically, the surfaces of these protective topcoatings are made as smooth and glossy as possible because such smooth and glossy surfaces have been thought to enhance the final image quality by improving heat transfer while minimizing friction as the paper goes past the thermal printhead. These protective topcoatings, however, tend to soften when heated.

As might be expected, higher quality topcoated thermal papers made with thicker, sized and highly calendared substrates, with smooth protective coatings and with thicker and more advanced heat-sensitive recording layer chemistries (referred to below as "topcoated thermal papers") are far more expensive than facsimile paper. Nevertheless, such topcoated thermal papers are widely used because facsimile papers have in the past been considered inadequate for many thermal printing applications.

Topcoated thermal papers are used in a wide variety of non-facsimile thermal printing applications such as in making tags, labels and tickets which bear alphanumeric symbols as well as bar codes or other machine-readable indicia. Often, thermally printed tags, labels and tickets are made by laminating topcoated thermal paper to a thicker cellulosic substrate by known processes. One such process is described in Goncalves, U.S. Pat. No. 5,092,949, which is directed to a laminated, thermally imageable baggage tag having a bottom layer, reinforcing fibers and a smooth topcoated thermal paper top sheet.

Although it has been thought that facsimile paper could be used only in applications in which relatively imprecise images are acceptable, such as in receiving facsimile transmissions, in plotting charts and graphs, and in calculators, it would be highly desirable to find a way in which facsimile paper could be simply and inexpensively enhanced to enable it to produce precise images on a par with current topcoated thermal papers. If such more precise images were obtainable, facsimile paper could be used in other thermal printing applications, including in making tags, labels and tickets which are to be printed with bar codes or other machine-readable indicia requiring a high degree of precision.

It is therefore an object of the present invention to provide a coating for facsimile paper which meters and directs the flow of heat from the heat point sources in a thermal printhead to the heat-sensitive recording layer of the paper in such a way that undesirable bloom is reduced or eliminated and an image of sufficient definition for bar code and other machine-readable applications can be produced.

These and other objects and advantages of the invention will become apparent to those skilled in the art upon consideration of the accompanying specification, claims and drawings.

SUMMARY OF THE INVENTION

In one important embodiment, the present invention comprises an enhanced thermal paper including a paper layer, a heat-sensitive recording layer, and a thermosetting organic polymeric-material-containing heat-metering layer. The heat-metering layer, in this embodiment, has an average surface smoothness of from about 40 to 350 on the Bekk smoothness scale and a surface toughness such that substantially no coated material is removed when the heat-metering layer is subjected to the Scrape Resistance Test described below. Other important thermal paper embodiments of the invention comprise the combination of the thermosetting material and the average surface smoothness range and the combination of the thermosetting material and the Scrape Resistance Test results.

In addition to various embodiments of the enhanced thermal paper, the present invention is also directed to methods of enhancing imaging characteristics of thermal paper including depositing a thermosetting organic polymeric-material-containing heat-metering layer onto the thermal paper before and after conventional printing.

BRIEF DESCRIPTION OF THE DRAWINGS

The invention, together with its objects and advantages, may be best understood by reference to the following description taken in conjunction with the accompanying drawings, in which like reference numerals identify like elements in the several figures, and in which.

DETAILED DESCRIPTION OF THE PREFERRED EMBODIMENTS OF THE INVENTION

The present invention is based on the discovery of a product for metering and directing the heat flow from the thermal printhead to the heat-sensitive recording layer in a way which produces minimal undesirable bloom and hence maximum image definition. This enhancement is thought to shift at least a portion of the heat flow at the interface between the coarse surface of the heat-metering layer and the thermal printhead to conduction rather than convection heating, as explained in further detail below.

Figure 1:
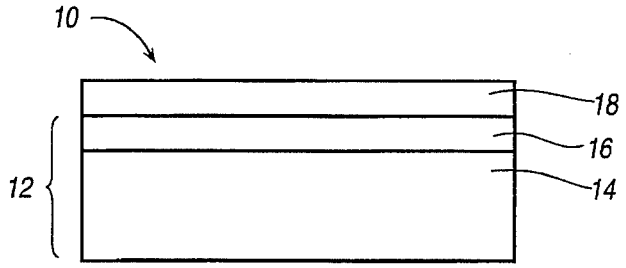
FIG. 1 is an enlarged partial elevation view of an enhanced facsimile paper in accordance with the present invention.
Figure 2:
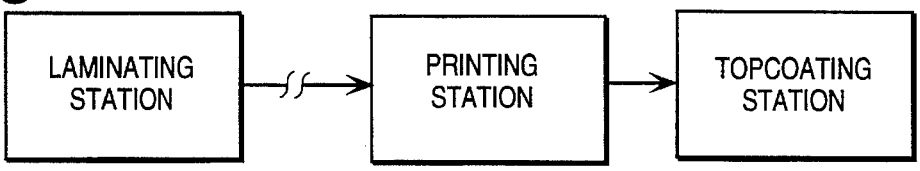
FIG. 2 is a schematic representation of an apparatus arranged for in-line conventional printing just prior to coating with a heat-metering layer.

In a preferred embodiment of the invention, as illustrated in FIG. 1, enhanced facsimile paper 10 is prepared, starting with conventional facsimile paper 12 which may be obtained from any commercial source. Conventional facsimile paper 12 comprises a paper substrate 14 and a heat-sensitive recording layer 16. In the embodiment depicted, the average surface roughness of the heat-sensitive recording layer may be about 350 Bekk.

As used herein and in the claims, the terms facsimile paper and fax paper mean a paper layer with a thermal chemistry coating on the paper layer to provide thermally activated imaging, characterized by (1) a basis weight of between 12 and 21 pounds per ream (base size—17"×22"); (2) little resistance to water, oils, fats, blood, alcohol and solvents; (3) poor archival quality for applications needing product and image stability longer than five years; and (4) a lack of capability to produce barcode imaging (or other machine readable indicia such as OCR) which is machine readable due to excessive bloom in imaging. Fax paper is to be understood as distinguishing from conventional topcoated thermal papers such as label, tag, and ticket grade papers, all of which are considerably more expensive than facsimile paper. It is clear that facsimile papers other than the fax paper specifically described herein will be usable and should produce enhanced fax papers in accordance with the present invention. Other thermal papers such as chart papers which are commercially uncoated, work-in-process papers (substrates with heat-sensitive recording layers that are to receive topcoatings to render them useable for commercial purposes) and thermal papers which, because they are to be provided with a heat-metering layer, may omit one or more ingredients made unnecessary by the heat-metering layer, also may be produced in accordance with this invention.

Commercial sources of facsimile paper provide "minimum" Bekk smoothness specifications for facsimile papers. These specifications, which may run as low as 200 Bekk, are only theoretical minimums. Average surface smoothnesses of the heat-sensitive recording layers of commercial facsimile papers tend to run at least 350 Bekk.

In accordance with this preferred embodiment of the invention, a coarse surfaced heat-metering layer 18 is applied to the heat-sensitive recording layer 16 of facsimile paper 10. Heat-metering layer 18 should have an average surface smoothness of about 40 to 350 Bekk, preferably about 60–250 Bekk, and most preferably about 75–175 Bekk.

It is also important that the heat-metering layer have a surface toughness such that substantially no coating material is removed therefrom when subjected to the Scrape-Resistance Test, as defined hereinafter.

While protection of the present invention is not intended to be limited or qualified by any theory underlying its operation, the inventors' current understanding of the operation of the coarse surfaced heat-metering layer of the invention will be set out below.

It is believed that images are formed in thermal papers by transferring heat from heat point sources of the thermal printhead to the heat-sensitive recording layer of the thermal paper by a combination of conduction and convection. Heat flow by conduction tends to be linear and focused, whereas heat flow by convection tends to be more non-linear and unfocused.

Since typical thermal printheads consist of a series of heating elements or point sources of heat disposed side-by-side, heat transfer, hence development of the heat-sensitive recording layer, is in corresponding side-by-side primary development zones. These primary development zones are produced principally by conduction from the heating point sources. The spaces between the primary development zones, however, are heated principally by convection to produce secondary development in the heat-sensitive recording layer. Unfortunately, the secondary development which desirably fills in the spaces between the primary development zones also undesirably causes tangent image growth in adjacent areas. This tangent image growth is the undesirable "bloom" referred to earlier.

In the past, it has been thought that providing the smoothest possible thermal paper surface topography would maximize heat transfer to the thermal imaging layer, thereby minimizing undesirable bloom and producing the most accurate image edge definition. In facsimile papers, sometimes this has sought to be achieved by calendering the heat-sensitive recording layer or including additives in the heat-sensitive recording layer to improve surface smoothness. In conventional thermal papers, as discussed above, where a protective topcoat is applied to the heat-sensitive recording layer, the topcoating is formulated and applied in ways to minimize thickness and maximize smoothness (e.g., flood coat application, slow drying additives and tunnel drying) and it also is calendared and otherwise treated to insure far smoother surface topographies than found in facsimile papers.

As explained earlier, it is believed that, in the case of enhanced facsimile papers, the heat-metering coating applied to the heat-sensitive recording layer 16 (FIG. 1), delivers a more focused heat image across the heat-metering coating to the heat-sensitive recording layer 16, than would be available using untreated facsimile paper.

The heat-metering layer of the embodiment of FIG. 1 can be made of any material which takes on the characteristics, in the dried coating, of a thermosetting material rather than the melting and softening characteristics of a thermoplastic material, and which: 1) can be coated onto the heat-sensitive recording layer of facsimile paper, 2) will conduct heat from the thermal printhead directly to the heat-sensitive recording layer in facsimile papers, 3) can be provided with a surface topography in the desired coarseness or Bekk reading range, and 4) has a surface toughness such that it resists removal of the coatings as determined by the Scrape-Resistance Test, as described below.

A variety of organic polymeric materials can be used to meet these requirements including polyacrylates, sulfonated polyacrylates, polystyrene/polybutadiene copolymers, polystyrene/polyacrylate copolymers, polyvinyl pyrrolidinones, polyvinyl acetate, polyvinyl chlorides, polyvinyl alcohol, and salts and halogenated forms of the above. Such polymeric materials preferably produce heat-metering layers having the characteristics of thermosetting resins, as in the manner described below. The organic polymeric material may be present in the heat-metering layer in amounts of from about 30 to about 50 weight percent of the active ingredients in the formulation.

As noted, the heat-metering layer should maintain surface coarseness and integrity as the enhanced facsimile paper of the invention is subjected to heat and pressure during the thermal printing process.

It is preferred that a lubricant be included in the heat-metering layer, particularly where the surface coarseness is at the lower end of the Bekk range. When wax is used as the lubricant, it should have a melting point of at least 100° C., and should be present at a level of at least 6 to 12% by weight of the material comprising the heat-metering layer. Preferably, about 0.5 to 7.0% by weight of a synthetic wax such as polyethylene or polypropylene wax will be used. One preferred synthetic wax is micronized polypropylene wax having a melting point of about 100° C. This wax has been found to minimize or eliminate head sticking and head abrasion.

The thickness of the heat-metering layer will range from 5 to 10 grams/square meter and preferably will be from 6 to 8 grams/square meter. Generally, slower or less sensitive heat-sensitive recording layers will require thinner heat-metering layers, particularly where the thermal paper is to be used in cooler operating thermal imaging heads.

The requisite coarseness in the surface of the heat-metering layer can be achieved using a direct roll coating process such as flexography, roll-to-roll coating and gravure. Other techniques such as spray coating could be used. In direct roll coating processes, the substrate is run through a set of rollers with a fixed gap which applies pressure to the surface. It is important that the wetting agents normally present in inks such as flexographic printing inks be absent since such agents promote smoothness.

Figure 3:
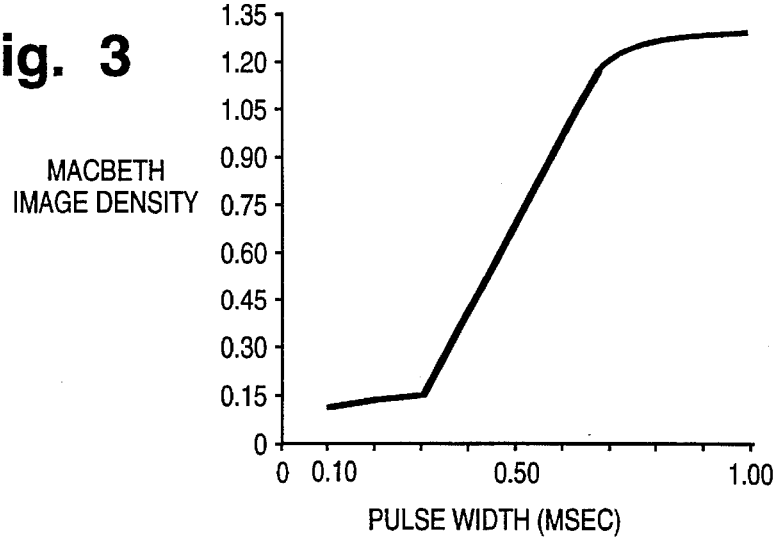
FIG. 3 is a graph displaying the dynamic sensitivity of a typical prior art facsimile paper, Appleton fax paper T-1022A.

Once applied, the coating is dried to the touch as quickly as possible (preferably within about 0.2 to 2.0 seconds of being deposited), in order to enhance surface coarseness and to make both coating of the heat-metering layer and conventional non-thermal printing and mechanical smoothening possible, in-line, preferably at equipment speeds of about 100–1200 feet per minute (fpm) and more preferably at about 200–700 fpm. In-line means printing and coating on the same press or on adjacent presses and without an intermediate rolling up or on storage of the stock. The use in the coating, as applied, of from almost 0.5 to 5.0% by weight of a drying agent such as ammonium hydroxide is preferred. Drying times short enough to permit application rates at speeds up to 600 feet per minute in the absence of forced air dryers are possible and will permit coating equipment to be added in-line to flexographic, roll-to-roll and gravure printers. FIG. 3 illustrates schematically in-line conventional printing (non-thermal) at a printing station just prior to coating with a heat-metering layer. The quick-drying character of the heat-metering coatings also make it possible to post-print in-line with the coating.

Thermal papers, including particularly facsimile paper to be coated with a heat-metering layer, may be laminated to backing paper to make tags, labels, tickets and other printed articles with the desired bulk and stiffness. The backing paper may be of any desired thickness although thicknesses of 3 to 10 points are preferred and thicknesses of 4 points or so are most preferred. Suitable backing materials include Kraft paper, heavy paper, such as Westvaco 61# paper, etc.

In accordance with the practice of the present invention, the heat-metering layer may be mechanically smoothened after the laminating step is completed or after the thermal paper has been made into pressure-sensitive label stock. This makes it possible to smoothen a completely assembled, finished laminated product, which greatly reduces surface imperfections which occur during laminating. It also permits smoothening at reduced pressures, compared to conventional practice in which smoothening of the topcoating is done before laminating is completed.

The mechanical smoothening, as by roller means, and as described in the examples hereafter, should preferably be at pressures and speeds which do not so heat the thermal imaging layer that development occurs, or that cooling is necessary to avoid darkening. By judiciously keeping pressure under control and speed to a level at which friction is minimized, the smoothening step will not adversely affect the integrity of the thermal layer. Nip pressures of about 75 and from 50 to 100 pounds per linear inch and speeds of 450 to 500 and up to 1000 ft. per minute are typically satisfactory. Usually, smoothening may be of the entire heat metering layer. Where desired, smoothening may be in selected zones or in a selected pattern.

Figure 4:
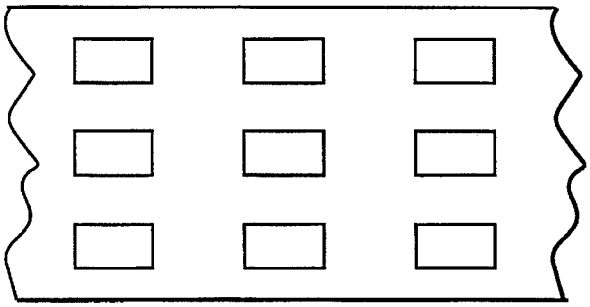
FIG. 4 is a plan view of a section of an enhanced thermal paper made in accordance with the present invention with the heat-metering layer deposited in selected zones only.

Although the heat-metering layer may be applied uniformly across the entire surface of the heat-sensitive recording layer of the thermal paper, if desired (and as illustrated by FIG. 4), it may be applied in a pattern in selected zones only of a running sheet to provide local zones in which imaging is to be provided. The adverse effects of bloom in imaging in other zones, where only human readability is desired, will not detract from its utility. Also different thicknesses of the heat-metering coating may be applied. For example a full thickness may be applied where bloom control is required for bar code purposes, and a thinner layer may be applied in areas where tight bloom control is not essential.

The following examples are given to further illustrate the present invention and are not intended to limit the scope thereof.

Example I

Coating compositions to be used for forming heat-metering layers were prepared by combining and mixing the following ingredients in the indicated percentages by weight:

| Ingredient | Amount |
|---|---|
| Composition A | |
| Nacrylic CP 3670 | 40.34% |
| Joncryl 89 | 41.53 |
| Glycol ether | 0.30 |
| Bacote 20 | 10.38 |
| Microspersion 31-40 | 1.27 |
| Cyaguard 2908 | 6.18 |
| | 100.00 |
| Composition B | |
| Nacrylic CP3670 | 38.29% |
| Joncryl 89 | 39.43 |
| Glycol ether | 2.87 |
| Bacote 20 | 10.47 |
| Microspersion 31-40 | 8.94 |
| | 100.00 |
| Composition C | |
| Nacrylic CP3670 | 31.20% |
| Joncryl 89 | 32.13 |
| Glycol ether | 0.23 |
| Bacote 20 | 8.03 |
| Microspersion 31-40 | 0.97 |
| Cyaguard 2908 | 4.79 |
| Water | 22.65 |
| | 100.00 |

The Nacrylic CP3670 in the above compositions is available from National Starch and Chemical Company, 10 Finderne Avenue, Bridgewater, N.J. It is an emulsion comprising hydrophobic carboxylated styrene-acrylic copolymer having about 45% solids by weight (the remainder water), a pH of about 7.0, a viscosity of less than 100 cps, a density of 8.7 lbs./gallon, and a glass transition temperature of 70° C.

The Joncryl 89 used in the above composition is available from S.C. Johnson Wax, Racine, Wis. It is an emulsion comprising a styrene acrylic copolymer having about 48% solids by weight (the remainder water), a pH of 8.0 to 8.5, a viscosity of 400–600 cps, a density of 8.7 lbs./gal., and a glass transition temperature of 98° C.

Bacote 20 is an aqueous ammonium zirconium carbonate solution available from Magnesium Elektron, Inc., of 500 Point Breeze Road, Flemington, N.J. 08822. It includes equivalent weight percentages of ammonia (8%) and zirconium compounds calculated as zirconium dioxide (20%).

Microspersion 31–40 is a micronized polypropylene wax of 40% solids ±1% in water. It has a pH of 9.0±0.5, a viscosity of 1000 cps ±500 cps., a density of 0.91 g/cc ±0.02 and an NPIRI grind of 5.0 to 6.0 based on ASTM-D-1316. It is available from Micro Powders, Inc., 580 White Plains Road, Tarrytown, N.Y.

Cyaguard UV-2908 is a 3,5-Di-t-butyl-4-hydroxybenzoic acid, n-hexadecyl ester having a molecular weight of 475, a melting point of 60° C., and a specific gravity of 1.07 at 25° C., and is available from American Cyanamid Company. It is a hindered benzoate low volatile, ultraviolet light stabilizer which provides antioxidant activity during thermal processing and at moderate elevated temperatures.

Example II

An Appleton T-1022A facsimile paper laminated to a Westvaco 61 pound backing sheet producing a 7.5 caliper (0.0075 inch) laminate was coated via the flexographic process in a coat weight of 7.5 grams/square meter (plus or minus about 10%) with a heat-metering layer comprising Composition C.

In this example, as is preferred, the heat-metering layer of the resulting product has the character of a thermosetting material, as distinguished from a thermoplastic material, thereby to provide optimum bloom control. It has been determined that the addition of zirconium ammonium carbonate not only assists in the drying of the compositions as they are applied but also "cross-links" with the polymeric components to form salts which tend, in the compositions described, to behave as thermosetting coatings, rather than as thermoplastic coatings.

The heat-metering layer behaves as a thermoset coating as distinguished from a thermoplastic coating in that like a thermoset compound it does not melt or flow and instead tends to decompose or burn upon the application of sufficient heat. A thermoplastic material, on the other hand, tends to melt before it decomposes or burns. A simple test of Composition B showed that it did not melt, but rather charred, and thus behaved as a thermosetting material. The thermoset coatings thus retained toughness and coarseness during imaging and therefore, as compared to thermoplastic type coatings, controlled bloom in a superior fashion. Although the Joncryl 89 and Nacrylic CP 3670 individually are thermoplastic materials, it is believed that the ammonium zirconium carbonate reacts or cross-links with them to form salts, and that the heat-metering layer then behaves like a thermosetting coating.

This helps produce heat-metering layers of improved toughness, hence layers which have greater bloom control when also provided with the requisite coarseness characteristics.

The resulting product was tested in accordance with the Scrape-Resistance Test and found to produce no scrapings (no residue). The resulting product was tested in accordance with the Bekk smoothness test and was found to have an average Bekk smoothness of 160 based on twenty tests.

The above enhanced facsimile paper was imaged with a bar and space pattern in an IER 411 Imager, Setting 1. The bars and spaces were 0.02 inch and 0.04 inch each, respectively. The resulting image was found to have an average ladder bloom of 0.0026 inch in the same twenty tests when measured with a Laser Check II LCT 2911 reader. That reader is made by Symbol Technologies of Behemia, N.Y. The reader employs a laser beam having an aperture of elliptical shape, at a nominal diameter of 0.009 inch and at a wavelength of 650 NM. The reader scans a given sample for one second at 36 scans per second and uses 25 of them to derive its measurement which is the actual amount of bloom versus an ideal bar code.

Although a wide range of low cost, conventional fax papers may be used in the practice of the present invention, one such fax paper which was used above is available from Appleton Papers Inc. of Appleton, Wis., and is identified as T-1022A. This is a standard sensitivity, black print paper for older, G-3 type fax units. It has the characteristics set forth in the following Table:

| | |
|---|---|
| Basic Weight (±5%) | 14.7 |
| 17 × 22 – 500 | 55.4 |
| gsm | |
| Thermal Response | |
| Dynamic (Atlantek 200-17.5 volts & 30 PC) | |
| (millijoules per sq. mm) | |
| 0.2 ODU | 0.15 |
| 1.0 ODU | 0.30 |
| Maximum Density | 1.26 |
| Energy Req'd. | 0.45 |
| Caliper (mils) | 2.35± 0.20 |
| Bekk smoothness (min.) | 200 |
| Image Color | Black |

The dynamic sensitivity of Appleton fax paper T-1022A is as shown on FIG. 3. The Atlantek test parameters for the graph of FIG. 3 include a printhead temperature of 30.0° C., printhead voltage of 17.5 volts, a Tcycle of 5.0 milliseconds, and a pattern of 50%.

The Bekk smoothness tests reported herein, unless otherwise specified, were conducted using a Bekk surface meter (TAPPE #T479, OM-91). In accordance with this test, a measurement of a specific amount of vacuum loss relative to a specific area (1.875 inches in diameter) was made. Vacuum loss was determined in seconds (reported as "Bekk") until the vacuum reached a predetermined point at which the reading was taken. As used herein, the Scrape-Resistance Test shall mean a test conducted in the following manner using a Weller Universal Soldering Dual Heat Gun employing the available 0.5 centimeter straight dull blade ("the Heat Gun").

Samples of coated thermal paper are cut into strips 2" wide by 11" long in the machine direction. An area 0.5 cm by 0.5 cm of a sample is gently scraped with the Heat Gun blade in the low heat setting to remove all coating materials in that area, and so that the white base paper becomes exposed. Thus substantially all of the coating, both applied coating and thermal imaging material, is removed in that area.

The sample is then carefully wiped down with a soft brush to remove any residue left on the paper from this operation and the caliper of the area scraped is measured. A backing paper is then taped to the sample so that the caliper in the scraped area of the sample measures 7.8 mils. The sample is then mounted on a test surface one inch in on the test surface.

The test surface is provided by a Chemsultants Adhesion/Release Tester with 12" test surface. The Heat Gun is mounted to a support, in this case being clampingly stabilized on a conventional ring stand, with the straight edge of the blade lying perpendicular to the direction of movement of the sample in the scraped area, being inclined at a 135 degree angle to the direction of movement of the sample being tested. A piece of backing paper is mounted to the back of the test surface so it will catch any residue resulting from the test. The Heat Gun is set to full power and turned on and allowed to warm at least one minute. The Release Tester is set to a speed of 60 feet per minute and turned on. The test surface then drags the sample underneath the Heat Gun blade. Once the full length of the sample is dragged under the blade, the Release Tester is turned off. Then the surface of the sample, the blade and the backing paper on the rear of the test surface are wiped with the soft brush to collect all residue from the test. The residue is then weighed in an analytical balance and recorded. Three samples are tested for each sample paper and the average weight is recorded.

Example III

An Appleton T-1022A facsimile paper laminated to a Westvaco 61 pound backing sheet producing a 7.5 caliper laminate was coated with a heat-metering coating comprising Composition C in a dry coat weight of 7.5 grams per square meter (plus or minus about 10%). The resulting product was mechanically smoothened and was tested in accordance with the Scrape-Resistance Test and found to produce no scrapings (no residue). The resulting product was also tested in accordance with the Bekk smoothness test and was found to have an average Bekk smoothness of 301 in sixteen tests. The resulting product was imaged in an IER 411 Imager, Setting 1, and was found to have an average ladder bloom of 0.0029 inch in the same sixteen tests when measured with a Laser Check II LCT 2911 reader as described above.

As noted the resulting product of Example III was mechanically smoothened after coating and drying resulting in a greater Bekk smoothness measurement. Such post-smoothening can produce good results so long as the toughness and the thermosetting character of the heat-metering layer are maintained.

Example IV

An Appleton T-1022 facsimile paper laminated to a Westvaco 61 pound backing sheet producing a 7.5 caliper laminate was coated with a heat-metering coating comprising Composition A in a dry coat weight of 7.5 grams per square meter (plus or minus about 10%). The resulting product was tested in accordance with the Scrape-Resistance Test and found to produce no scrapings (no residue). The resulting product also was tested in accordance with the Bekk smoothness test and was found to have an average Bekk smoothness of 93 in twenty tests. The resulting product was imaged in an IER 411 Imager, Setting 1, and was found to have an average ladder bloom of 0.0028 inch in the same twenty tests when measured with a Laser Check II LCT 2911 reader as described above.

Example V

An Appleton T-1022A facsimile paper laminated to a Westvaco 61 pound backing sheet producing a 7.5 caliper laminate was coated with a heat-metering coating comprising Composition A in a dry coat weight of 7.5 grams per square meter (plus or minus about 10%). The resulting product was mechanically smoothened and was tested in accordance with the Scrape-Resistance Test and found to produce no scrapings (no residue). The resulting product also was tested in accordance with the Bekk smoothness test and was found to have an average Bekk smoothness of 199 in twenty tests. The resulting product was imaged in an IER 411 Imager, Setting 1, and was found to have an average ladder bloom of 0.0025 inch in the same twenty tests when measured with a Laser Check II LCT 2911 reader as described above.

Example VI

An Appleton T-1022A facsimile paper laminated with a hot melt adhesive to a backing sheet producing a 10 point caliper laminate was coated with a heat-metering coating comprising Composition B in a dry coat weight of 7.5 grams per square meter (plus or minus about 10%). The resulting product was tested in accordance with the Scrape-Resistance Test and found to produce no scrapings (no residue). The resulting product also was tested in accordance with the Bekk smoothness test and was found to have an average Bekk smoothness of 41 in twenty tests. The resulting product was imaged in an IER 411 Imager, Setting 1, and was found to have an average ladder bloom of 0.001 inch in the same twenty tests when measured with a Laser Check II LCT 2911 reader as described above.

Example VII

An Appleton T-1022A facsimile paper laminated with a hot melt adhesive to a Kraft backing sheet producing a 7.5 caliper laminate was coated with a heat-metering coating comprising Composition B in a dry coat weight of 7.5 grams per square meter (plus or minus about 10%). The resulting product was tested in accordance with the Scrape-Resistance Test and found to produce no scrapings (no residue). The resulting product also was tested in accordance with the Bekk smoothness test and was found to have an average Bekk smoothness of 56 in twenty tests. The resulting product was imaged in an IER 411 Imager, Setting 1, and was found to have an average ladder bloom of 0.0014 inch in the same twenty tests when measured with a Laser Check II LCT 2911 reader as described above.

Example VIII

An Appleton T-1022A facsimile paper laminated with a hot melt adhesive to a Kraft backing sheet producing a 7.5 caliper laminate was coated with a heat-metering coating comprising Composition B in a dry coat weight of 7.5 grams per square meter (plus or minus about 10%). The resulting product was mechanically smoothened and was tested in accordance with the Scrape-Resistance Test and found to produce no scrapings (no residue). The resulting product also was tested in accordance with the Bekk smoothness test and was found to have an average Bekk smoothness of 597 in twenty tests. The resulting product was imaged in an IER411 Imager, Setting 1, and was found to have an average ladder bloom of 0.0028 inch in the same twenty tests when measured with a Laser Check II LCT 2911 reader as described above.

Example IX

The papers coated as described in connection with Examples IV and VII were imaged in a Miltope 4550A/μ Imager. Such a Miltope Imager is available from Miltope Corporation, 1770 Walt Whitman Road, Melville, N.Y. 11747.

The ladder bar code bloom characteristics in ten tests each were determined to be as follows:

| Example | Ladder Bloom |
|---|---|
| IV | 0.0009 |
| VII | 0.0008 |

Example X

The Scrape-Resistance Tests were conducted on commercial top-coated thermal papers with the following results:

| | Grams Removed |
|---|---|
| Appleton 982 | 0.0069 |
| Ricoh 150 | 0.0130 |
| Appleton 954 | 0.0058 |
| Jujo TC15KS-25 | 0.0079 |
| Kanzaki 880 | 0.0079 |
| Ricoh 120 | 0.0115 |

Example XI

An Appleton T1022A facsimile paper was bulked by laminating to label caliper and coated with a heat-metering coating comprising Composition B in a dry coat weight of about 7.5 grams per square meter (plus or minus about 10%). The resulting product was tested in accordance with the Scrape Resistance Test and found to produce no scrapings (no residue). The resulting product also was tested in accordance with the Bekk smoothness test and was found to have an average Bekk smoothness of 46 in 20 tests. The resulting product was imaged in an IER411 Imager Setting 1, and was found to have an average ladder bloom of 0.0018 inch in the same 20 tests when measured with a Laser Check II LCT 2911 reader as described above.

It will be apparent to those skilled in the art that modifications may be made in the specific embodiments described herein without departing from the spirit and scope of the invention. As such it is intended that the invention is not to be considered as being limited thereto, except as may be specifically required by the appended claims.

What is claimed is:

1. An enhanced thermal paper comprising a paper layer with a heat-sensitive recording layer thereon, and on the heat-sensitive recording layer, a thermosetting organic polymeric-material-containing heat-metering layer having an average surface smoothness of from 50 to 250 on the Bekk smoothness scale, and a surface toughness such that substantially no coating material is removed therefrom when subjected to the Scrape-Resistance Test.

2. An enhanced thermal paper in accordance with claim 1, and wherein said enhanced thermal paper, when subjected to thermal ladder imaging, has a ladder bloom of no more than about 0.003 inch.

3. An enhanced thermal paper is accordance with claim 1, and wherein said paper layer with said heat-sensitive recording-layer is a facsimile paper.

4. An enhanced thermal paper in accordance with claim 1, and wherein said enhanced thermal paper is underprinted with conventional non-thermal printing.

5. An enhanced thermal paper in accordance with claim 1, and wherein said thermal paper is a pressure sensitive label.

6. The enhanced thermal paper of claim 1 in which said heat-metering layer has an average surface smoothness of about 60–250 Bekk.

7. The enhanced thermal paper of claim 1 in which said heat-metering layer has an average surface smoothness of about 75–200 Bekk.

8. The enhanced thermal paper of claim 1 in which said heat-sensitive recording layer includes a combination of leuco dye and an acidic coreactant.

9. The enhanced thermal paper of claim 1 in which said heat-metering layer includes from 30 to 50 percent by weight of organic polymeric-material-containing material.

10. The enhanced thermal paper of claim 1 in which said heat-metering layer includes about 40 to 80 percent by weight of a polystyrene/polyacrylate copolymer.

11. The enhanced thermal paper of claim 1 in which said heat-metering layer includes a cross-linking agent.

12. The enhanced thermal paper of claim 11 in which said crosslinking agent is ammonium zirconium carbonate.

13. The enhanced thermal paper of claim 1 in which said heat-metering layer includes a drying agent.

14. The enhanced thermal paper of claim 13 in which said drying agent is ammonia.

15. The enhanced thermal paper of claim 1 in which a lubricant is incorporated into the heat-metering layer.

16. The enhanced thermal paper of claim 15 in which said lubricant is a micronized polypropylene wax dispersion.

17. The enhanced thermal paper of claim 16 in which said micronized polypropylene wax dispersion is present in the heat-metering layer at a level of about 0.5 to 7.0 percent by weight.

18. The enhanced thermal paper of claim 1 in which said heat-metering layer is deposited from a composition including styrene-acrylic copolymer, micronized polypropylene wax, glycol ether, and ammonia.

19. The enhanced thermal paper of claim 1 in which said heat-metering layer is present in a weight of from about 5 to about 10 grams/square meter.

20. The enhanced thermal paper of claim 1 in which said heat-metering layer is applied to the heat-sensitive recording layer in discrete spaced zones.

21. The enhanced thermal paper of claim 1 in which said heat-metering layer is applied to different zones in different weights.

22. A pressure sensitive label comprising a paper layer with a heat-sensitive recording layer on one side and a pressure sensitive adhesive layer on the other side, and on the heat-sensitive recording layer, a thermosetting organic polymeric-material-containing heat-metering layer having an average surface smoothness of from 40 to 250 on the Bekk smoothness scale, and a surface toughness such that substantially no coating material is removed therefrom when subjected to the Scrape-Resistance Test.

23. A pressure sensitive label in accordance with claim 22, and wherein said paper layer includes a facsimile paper bearing said heat-sensitive recording layer.

24. An enhanced thermal paper comprising a paper layer with a heat-sensitive recording layer thereon, and on the heat-sensitive recording layer, a thermosetting organic polymeric-material-containing heat-metering layer having an average surface smoothness off from 40 to 250 on the Bekk smoothness scale.

25. An enhanced thermal paper in accordance with claim 24, and wherein said enhanced thermal paper, when subjected to thermal ladder imaging, has a ladder bloom of no more than about 0.003 inch.

26. An enhanced thermal paper in accordance with claim 24, and wherein said paper layer with said heat-sensitive recording layer is a facsimile paper.

27. An enhanced thermal paper in accordance with claim 24, and wherein said enhanced thermal paper is underprinted with conventional non-thermal printing.

28. An enhanced thermal paper in accordance with claim 24, and wherein said thermal paper is a pressure sensitive label.

29. The enhanced thermal paper of claim 24 in which said heat-metering layer has an average surface smoothness of about 60–250 Bekk.

30. The enhanced thermal paper of claim 24 in which said heat-metering layer has an average surface smoothness of about 75–200 Bekk.

31. The enhanced thermal paper of claim 24 in which said heat-sensitive recording layer includes a combination of leuco dye and an acidic coreactant.

32. The enhanced thermal paper of claim 24 in which said heat-metering layer includes from 30 to 50 percent by weight of organic polymeric-material-containing material.

33. The enhanced thermal paper of claim 24 in which said heat-metering layer includes about 40 to 80 percent by weight of a polystyrene/polyacrylate copolymer.

34. The enhanced thermal paper of claim 24 in which said heat-metering layer includes a cross-linking agent.

35. The enhanced thermal paper of claim 34 in which said crosslinking agent is ammonium zirconium carbonate.

36. The enhanced thermal paper of claim 34 in which said heat-metering layer includes a drying agent.

37. The enhanced thermal paper of claim 36 in which said drying agent is ammonia.

38. The enhanced thermal paper of claim 24 in which a lubricant is incorporated into the heat-metering layer.

39. The enhanced thermal paper of claim 38 in which said lubricant is a micronized polypropylene wax dispersion.

40. The enhanced thermal paper of claim 39 in which said micronized polypropylene wax dispersion is present in the heat-metering layer at a level of about 0.5 to 7.0 percent by weight.

41. The enhanced thermal paper of claim 24 in which said heat-metering layer is deposited from a composition including styrene-acrylic copolymer, micronized polypropylene wax, glycol ether, and ammonia.

42. The enhanced thermal paper of claim 24 in which said heat-metering layer is present in a weight of from about 5 to about 10 grams/square meter.

43. The enhanced thermal paper of claim 24 in which said heat-metering layer is applied to the heat-sensitive recording layer in discrete spaced zones.

44. The enhanced thermal paper of claim 43 in which said heat-metering layer is applied to different zones in different weights.

45. An enhanced thermal paper comprising a paper layer with a heat-sensitive recording layer thereon, and on the heat-sensitive recording layer, a thermosetting organic polymeric-material-containing heat-metering layer having a surface toughness such that substantially no coating material is removed therefrom when subjected to the Scrape Resistance Test, and in which said heat-metering layer has an average surface smoothness of about 60–250 Bekk.

46. An enhanced thermal paper comprising a paper layer with a heat-sensitive recording layer thereon, and on the heat-sensitive recording layer, a thermosetting organic polymeric-material-containing heat-metering layer having a surface toughness such that substantially no coating material is removed therefrom when subjected to the Scrape-Resistance Test, and in which said heat-metering layer has an average surface smoothness of about 75–200 Bekk.

* * * * *